US007032748B2

(12) United States Patent
Conklin

(10) Patent No.: US 7,032,748 B2
(45) Date of Patent: Apr. 25, 2006

(54) PORTABLE DISPENSERS FOR FASTENING MEANS

(76) Inventor: William M. Conklin, 10127 Grand View Ct., Traverse City, MI (US) 49684

( * ) Notice: Subject to any disclaimer, the term of this patent is extended or adjusted under 35 U.S.C. 154(b) by 131 days.

(21) Appl. No.: 10/446,642

(22) Filed: May 28, 2003

(65) Prior Publication Data

US 2004/0238389 A1 Dec. 2, 2004

(51) Int. Cl.
*B65D 85/24* (2006.01)

(52) U.S. Cl. ..... 206/338; 206/349

(58) Field of Classification Search ..... 206/372, 206/373, 374, 338–347, 229, 349; 221/303, 221/309, 312 R, 197
See application file for complete search history.

(56) References Cited

U.S. PATENT DOCUMENTS 1,910,168 A * 5/1933 Jacobs ..... 294/142
2,023,450 A * 12/1935 Tanner ..... 206/45.27
2,555,380 A 6/1951 Stuart et al.
3,390,761 A 7/1968 Jeanfavre
3,485,354 A 12/1969 Bader
3,831,743 A 8/1974 Leedy
D248,128 S * 6/1978 Mineo ..... D6/514
4,365,709 A * 12/1982 Lester ..... 206/362
4,560,062 A * 12/1985 Valiulis ..... 206/774
4,580,695 A * 4/1986 Lum ..... 221/52
4,928,823 A * 5/1990 Campbell ..... 206/338
D310,760 S * 9/1990 Murphy ..... D6/515
5,020,663 A 6/1991 Dallas et al.
D404,199 S 1/1999 Letson
6,026,519 A * 2/2000 Kaluza ..... 4/144.1
6,098,818 A * 8/2000 Ali et al. ..... 211/50

* cited by examiner

*Primary Examiner*—Shian T. Luong
(74) *Attorney, Agent, or Firm*—Irving M. Weiner; Pamela S. Burt; Weiner & Burt, P.C.

(57) ABSTRACT

Portable dispensers for coiled roofing nails, nail strips, roof staples, sheathing staples, welding tools, framing nails and the like. The dispenser has an open top container which may be fastened to the belt of the user.

2 Claims, 7 Drawing Sheets

FIG. 1
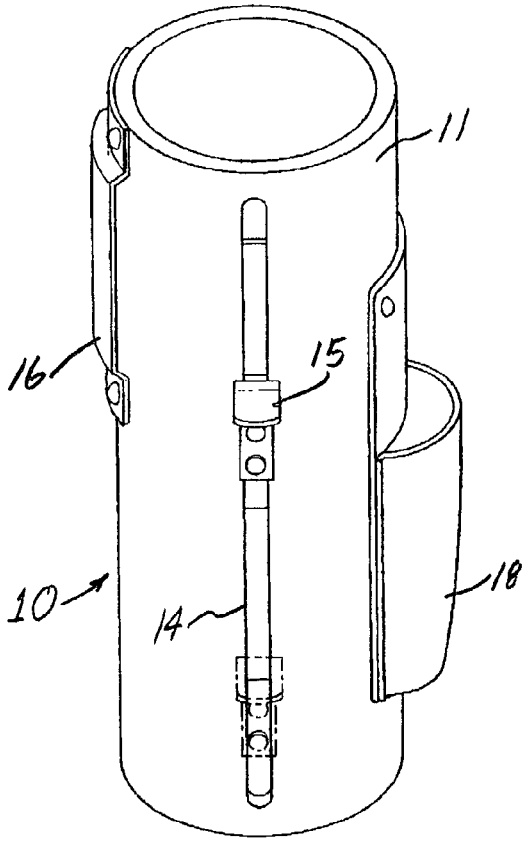
FIG. 3
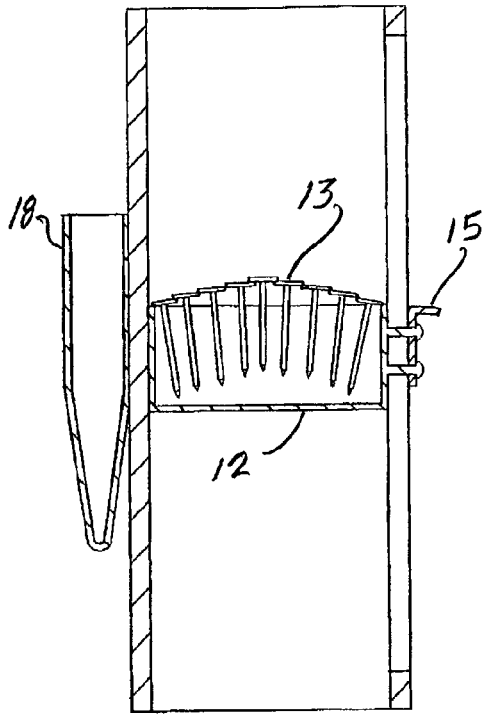
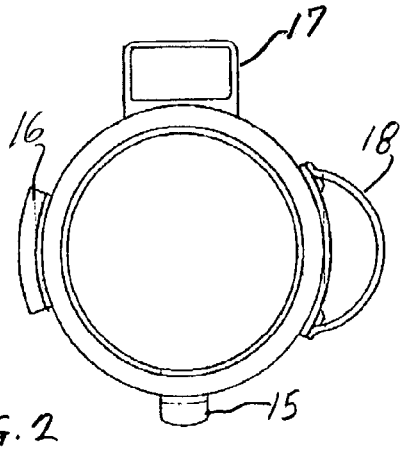
FIG. 2
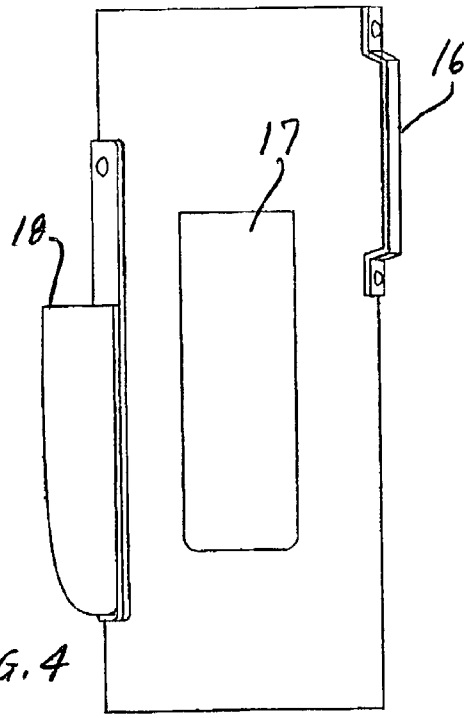
FIG. 4

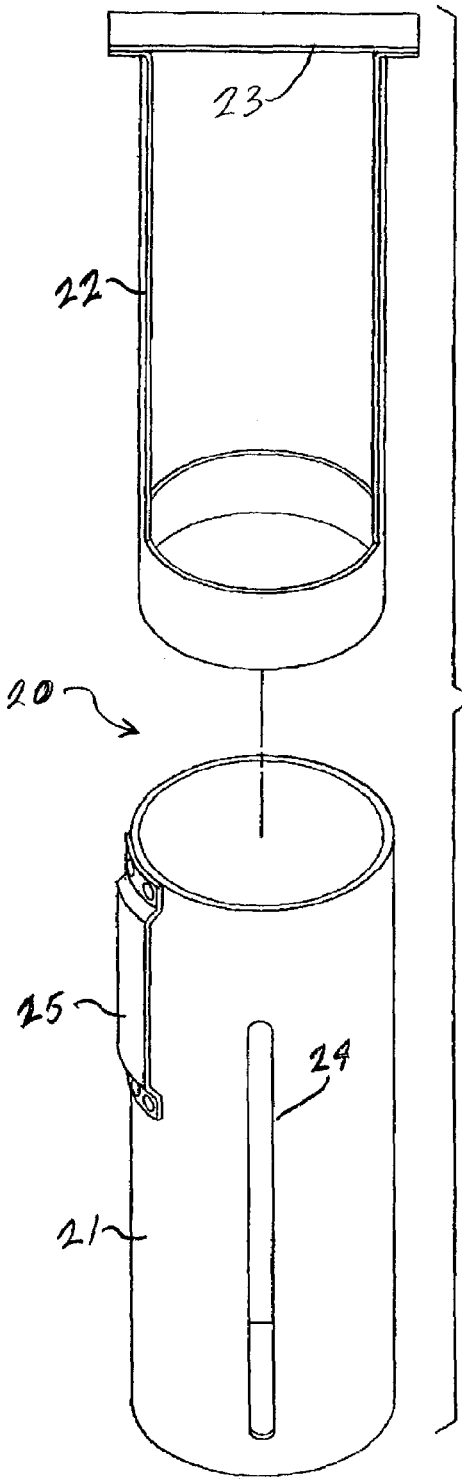
FIG. 5
FIG. 6
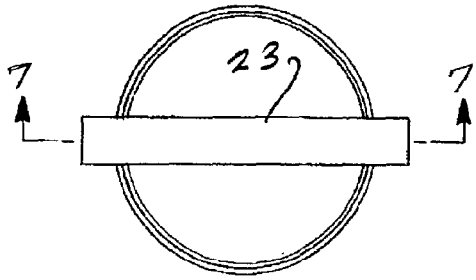
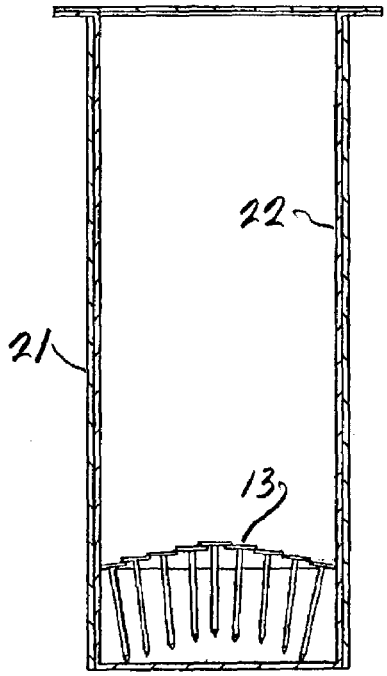
FIG. 7

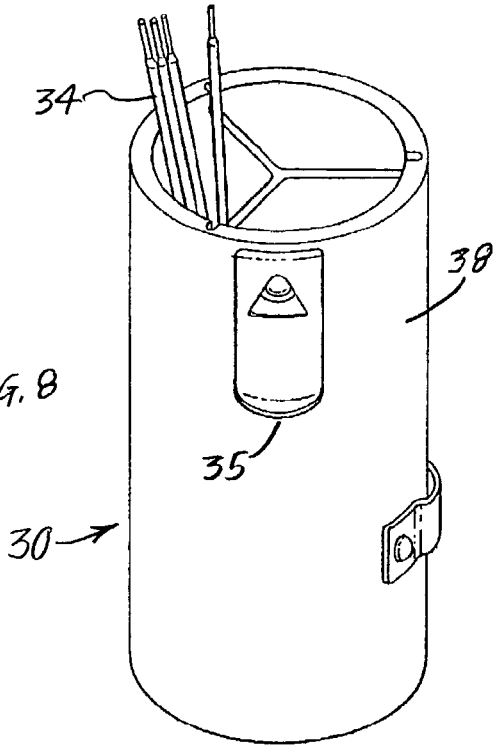
FIG. 8
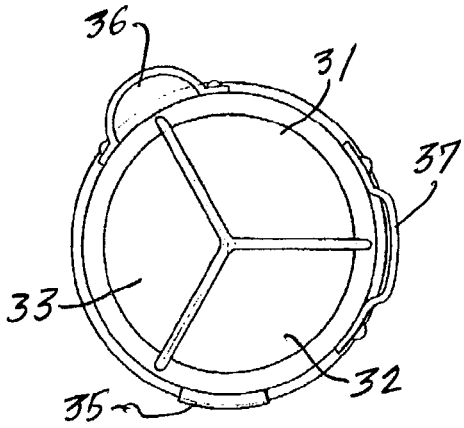
FIG. 10
FIG. 9
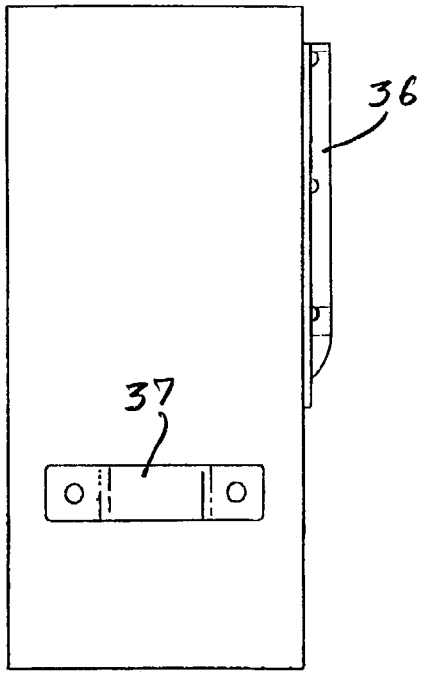
FIG. 11
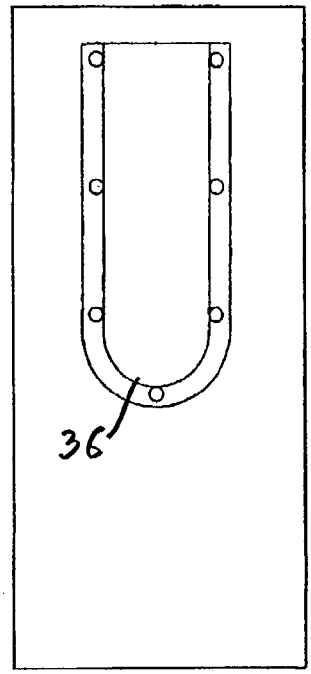

FIG. 24
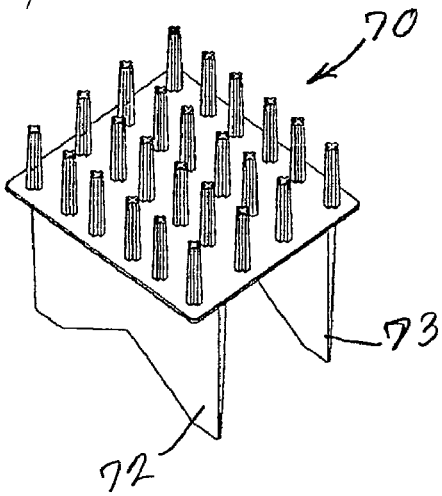
FIG. 26
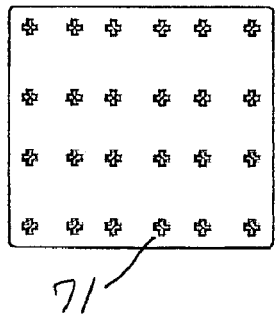
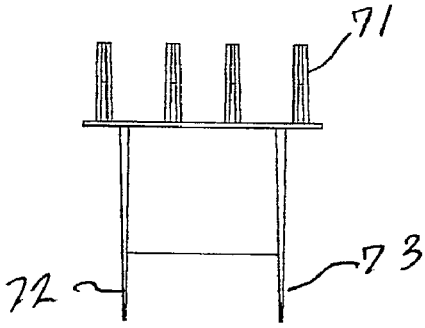
FIG. 25
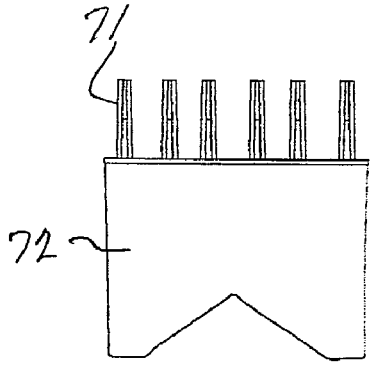
FIG. 27

PORTABLE DISPENSERS FOR FASTENING MEANS

The present invention relates generally to portable dispensers for temporarily holding and presenting a plurality of articles.

More particularly, the present invention relates to portable dispensers of coiled roofing nails, nail strips, roof staples, sheathing staples, welding rods, roofing nails, cartridge holders for diagonal nails which are put in a cartridge nail gun, framing nails, trim nails, and the like.

BACKGROUND OF THE INVENTION

Tradesmen and other persons working in the construction field, such as roofers and welders, require their equipment and supplies to be readily accessible and portable.

The prior art is exemplified by: Stuart et al. U.S. Pat. No. 2,555,380; Jeanfavre U.S. Pat. No. 3,390,761; Bader U.S. Pat. No. 3,485,354; Leedy U.S. Pat. No. 3,831, 743; Dallas et al. U.S. Pat. No. 5,020,663; and Letson U.S. Des. Pat. No. 404,199.

It is a desiradatum of the present invention to provide novel and unique portable dispensers for a plurality of articles, while avoiding the animadversions of the prior art and conventional dispensers.

SUMMARY OF THE INVENTION

The present invention provides a portable dispenser for a plurality of articles, comprising:an open top container provided with first means therein for temporarily holding said plurality of articles and for making said plurality of articles readily accessible to a user of said portable dispenser; and second means provided on a first exterior surface of said open top container for removably and selectively attaching said portable dispenser to a belt of said user of said portable dispenser.

One object of the present invention is to provide a portable dispenser as described hereinabove, wherein the dispenser is substantially cylindrical in shape and holds coiled roofing nails in a stack of six to eight coils.

Another object of the present invention is to provide a portable dispenser as described hereinabove, wherein the dispenser is designed to hold coiled roofing nails so that they will not uncoil and remain whole.

A further object of the present invention is to provide a portable dispenser as described hereinabove, wherein the dispenser is secured on the belt of the user of the dispenser so as to be accessible with one hand of the user while holding a nail gun with the other hand, thus readily enabling the retrieving of nails on the move.

Yet a further object of the present invention is to provide portable dispensers as described hereinabove, wherein the dispenser may be attached to the roofer's belt and which allows for quick and easy access to the coils of roofing nails from the top of the dispenser.

An additional object of the present invention is to provide the novel portable dispensers as described hereinabove, wherein by attaching a knife and a snip holder, the roofer can have all of his necessary tools at his fingertips, mounted on the outside of the dispenser.

Another object of the invention is to provide portable dispensers as described hereinabove, wherein the portable dispenser is provided with means for removably holding a tape measure thereon.

An additional object of the present invention is to provide a portable dispenser as described hereinabove, wherein the dispenser can be used for holding welding rods therein.

Another object of the present invention is to provide a portable dispenser as described hereinabove, wherein there is provided on the exterior of the dispenser means for holding soapstone.

Further objects, advantages and features of the present invention will become apparent to those persons skilled in this particular area of technology and to others after being exposed to the following detailed specification and accompanying drawings.

BRIEF DESCRIPTION OF THE DRAWINGS

FIG. 1 is a perspective view of a portable dispenser in accordance with a first embodiment of the present invention.

FIG. 2 is a top view of the FIG. 1 embodiment.

FIG. 3 depicts a vertical cross-sectional view of the FIG. 1 embodiment.

FIG. 4 illustrates a vertical elevational view of the FIG. 1 embodiment.

FIG. 5 illustrates a perspective view of a portable dispenser in accordance with a second embodiment of the present invention.

FIG. 6 depicts a top view of the FIG. 5 embodiment.

FIG. 7 illustrates a vertical cross-sectional view taken along the line 7—7 shown in FIG. 6.

FIG. 8 illustrates a perspective view of a portable dispenser in accordance with a third embodiment of the present invention.

FIG. 9 depicts an elevational view taken from one side of the FIG. 8 embodiment.

FIG. 10 depicts a top plan view of the FIG. 8 embodiment.

FIG. 11 illustrates an elevational view taken from another side of the FIG. 8 embodiment.

FIG. 24 depicts a perspective view of a staple holder unit structure which may be used in conjunction with the embodiment illustrated in FIG. 20–23.

FIG. 25 illustrates a front elevational view of the FIG. 24 structure.

FIG. 26 depicts a top plan view of the FIG. 24 structure.

FIG. 27 illustrates a side elevational view of the FIG. 24 structure.

DETAILED DESCRIPTION OF SOME PREFERRED EMBODIMENTS OF THE PRESENT INVENTION

Figure 12:
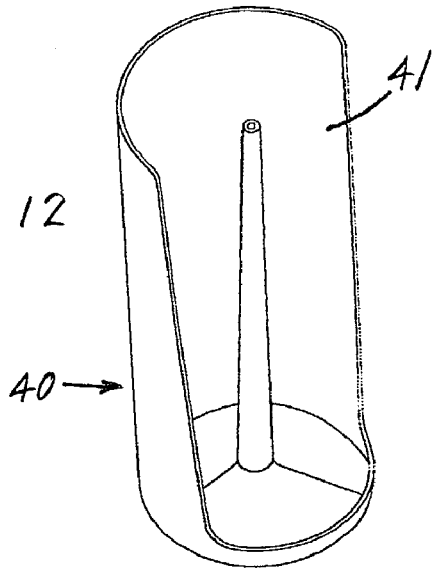
FIG. 12 depicts a perspective view of a portable dispenser in accordance with a fourth embodiment of the present invention.

FIGS. 1–4 illustrate a portable dispenser 10 according to a first embodiment of the present invention.

The portable dispenser 10 comprises an open top container 11 provided with first means therein, such as a sliding disc or other structure 12, upon which may be stacked several coils of roofing nails 13. One such coil of roofing nails 13 is shown for illustration in FIG. 3.

The open top container 11 is provided with a longitudinal groove 14 within which is slidably positioned a thumb lever device 15 which is attached to the sliding disc 12. The thumb lever device 15 is shown in phantom line at the bottom of FIG. 1, and is also shown in an elevated position in the upper central portion of FIG. 1. The user of the dispenser 10 merely hooks his thumb under the thumb lever device 15 and raises the sliding disc 12 with the coils of roofing nails 13 thereon by sliding it in the groove 14 until the coil of roofing nails 13 is accessible to the user near the open top of the container 11. Upon taking an uppermost coil of roofing nails 13, the disc 12 then slides down and returns to its lowermost position.

The dispenser 10 is provided with second means, in the form of a belt loop device 16, through which the belt of the user may be placed so that the portable dispenser 10 may be removably attached to the belt of the user.

The portable dispenser 10 may also be provided with a knife holder 17 for holding a knife for cutting roof shingles, and a sheath 18 for holding a snips tool.

The portable dispenser 10 illustrated in FIGS. 1–4 is dimensioned to hold six to eight coils of roofing nails 13.

FIGS. 5–7 illustrate a portable dispenser 20 according to a second embodiment of the present invention.

The portable dispenser 20 comprises an open top container 21 within which a second container 22 is slidably disposed. Six to eight coils of roofing nails 13 may be held in the second container 22. For illustration purposes, a coil of roofing nails 13 is shown in the second container 22 in FIG. 7.

The second slidable container 22 is provided with gripping means, such as a handle 23, at the top end of the second container 22 to enable the user to move the second slidable container 22 upwardly to gain access to the topmost of the coils of roofing nails 13.

The open top container 21 is provided with a longitudinal groove 24 to enable the user to readily see at a glance how many coils of roofing nails 13 are still left in the dispenser 20.

The dispenser is also provided with a belt loop device 25, similar to the device 16 shown in FIGS. 1–4.

FIGS. 8–11 illustrate a portable dispenser 30 according to a third embodiment of the present invention.

The portable dispenser 38 is provided with an open top container 38 having a plurality of compartments 31, 32 and 33 for temporarily holding a plurality of articles, such as welding rods 34, and for making the welding rods 34 readily accessible to the user of the portable dispenser.

The portable dispenser 30 is provided with a clip 35 to enable the dispenser 30 to be clipped on to the belt of the user. The dispenser 30 is also provided with a pocket 36 for holding soapstone and the like. In addition, the dispenser 30 is provided with a clip 37 upon which a tape measure may be removably held.

FIGS. 12–15 illustrate a portable dispenser 40 according to a fourth embodiment of the present invention.

The dispenser 40 is provided with a substantially semi-cylindrical open top container 41. From the bottom surface 42 of the open top container 41 there extends an elongated member 43 along the central elongated major axis of the open top container 41. A plurality of articles, such as a plurality of coils of roofing nails 13, may be readily placed on the elongated member 43 for temporarily holding same thereon.

Figure 14:
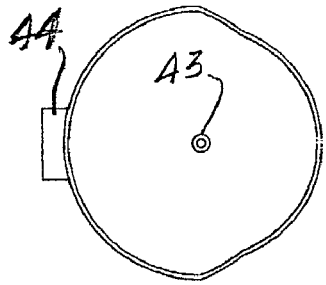
FIG. 14 illustrates a top plan view of the FIG. 12 embodiment.
Figure 13:
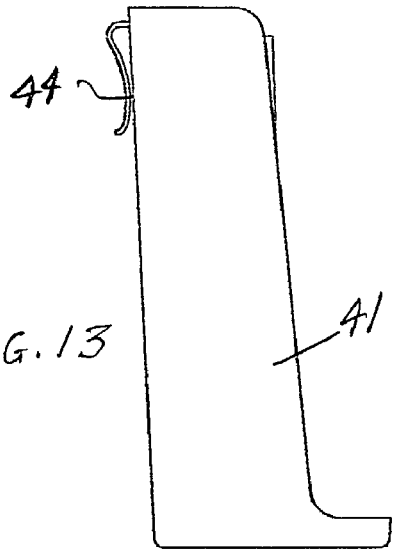
FIG. 13 depicts a side elevational view of the FIG. 12 embodiment.
Figure 15:
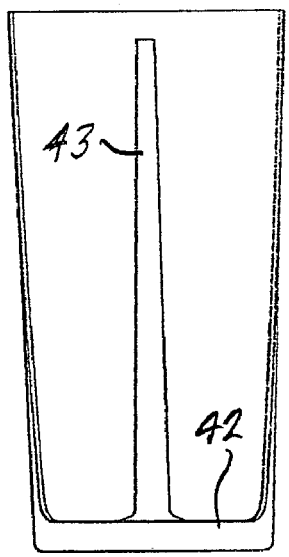
FIG. 15 illustrates an elevational view of the FIG. 12 embodiment facing the major opening in the side of the portable dispenser.
Figure 16:
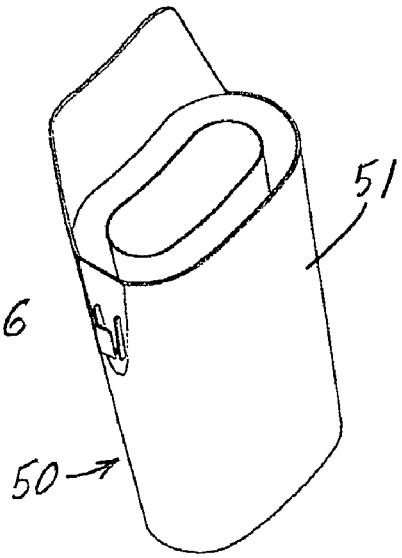
FIG. 16 depicts a perspective view of a portable dispenser in accordance with a fifth embodiment of the present invention.
Figure 18:
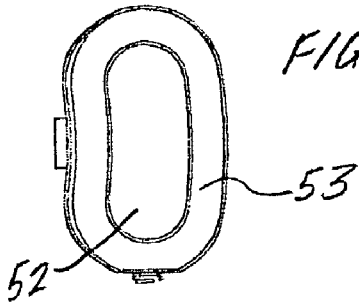
FIG. 18 illustrates a top plan view of the FIG. 16 embodiment.
Figure 17:
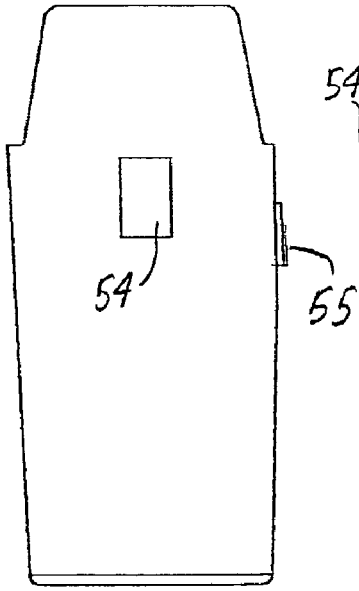
FIG. 17 illustrates an elevational view of the back of the FIG. 16 embodiment.
Figure 19:
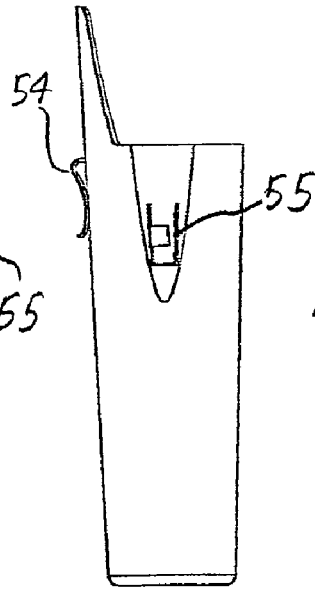
FIG. 19 depicts a side elevational view of the FIG. 16 embodiment.
Figure 20:
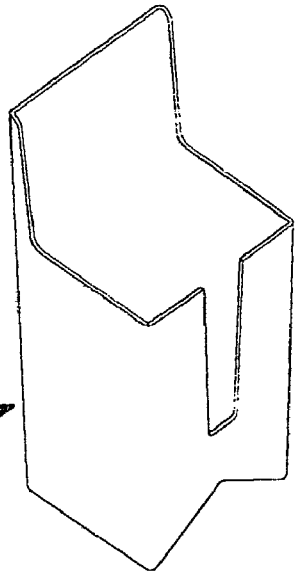
FIG. 20 illustrates a perspective view of a portable dispenser in accordance with a sixth embodiment of the present invention.
Figure 22:
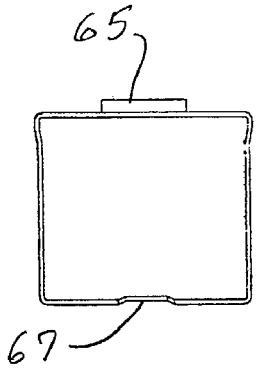
FIG. 22 illustrates a top plan view of the FIG. 20 embodiment.
Figure 21:
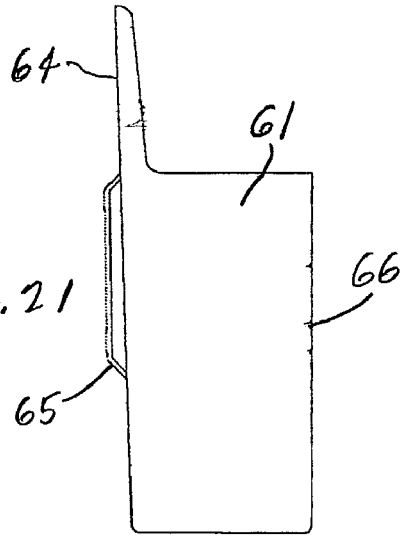
FIG. 21 depicts a side elevational view of the FIG. 20 embodiment.
Figure 23:
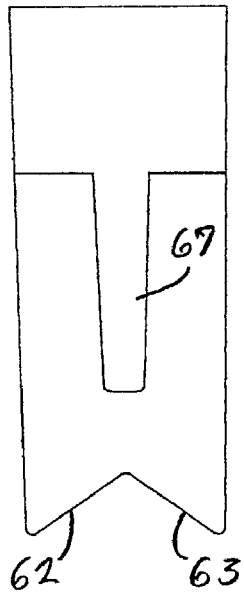
FIG. 23 illustrates a front elevational view of the FIG. 20 embodiment.

As shown in FIGS. 13 and 14, the portable dispenser 40 is provided with a clip 44 for removably holding the dispenser 40 on the belt of the user. Here again, the dispenser 40 may hold six to eight coils of roofing nails 13.

FIGS. 16–19 illustrate a portable dispenser 50 according to a fifth embodiment of the present invention.

The portable dispenser 50 comprises an open top container 51 for holding welding rods 34 therein. The dispenser 50 is provided with a first compartment 52 and a second compartment 53. The second compartment 53 surrounds the first compartment 52, is coaxial therewith, and is similarly shaped thereto.

The dispenser 50 is provided with a clip 54 to enable the dispenser 50 to be clipped onto the belt of the user. In addition, the dispenser 50 is provided with holding means 55 for removably holding a small article, such as soapstone and the like.

FIGS. 20–23 illustrate a portable dispenser 60 according to a sixth embodiment of the present invention.

The portable dispenser 60 comprises an open top container 61 having a substantially rectangular cross section which is disposed substantially perpendicular to a vertical elongated axis of the container 61.

The open top container 61 has a bottom portion formed by two surfaces 62 and 63 disposed oblique to the vertical elongated axis of the container 61. The tallest surface 64 of the container 61 is provided with a loop device 65 through which the belt of the user may be passed for holding the dispenser 60 on the belt of the user.

A parallel opposite surface 66 of the container 61 is provided with an elongated notch 67 therein.

The portable dispenser 60 shown in FIGS. 20–23 is adapted to be used with the staple holder unit structure 70 illustrated in FIGS. 24–27.

With reference to FIGS. 24–27, there is shown a staple holder unit structure 70 for holding roof and/or sheathing staples 71.

The staple holder unit structure 70 is provided with members 72 and 73 which fit on and mate with the bottom portion of the embodiment illustrated in FIGS. 20–23.

It should be noted that the staples 71 may be arranged in rows and columns as illustrated in FIGS. 24–27 if desired.

With reference to the embodiments of the invention described hereinabove which hold coiled roofing nails 13, it should be noted that such coiled roofing nails 13 are held in a cylindrically-shaped dispense so that they will not uncoil and remain whole. The dispenser may be secured to the belt of the roofer or other user so as to be accessible with one hand while holding a nail gun in the other hand, thus retrieving the nails 13 on the move.

Preferably, but not necessarily, a four inch diameter plastic portable dispenser will allow coiled one and one-quarter inch roofing nails 13 to be stacked on top of each other.

By attaching the portable dispenser to the roofer's belt, it permits for quick and easy access to the coils of roofing nails 13 from the top of the dispenser. Furthermore, by attaching knife and snip holders 17 and 18, the roofer can have all of his necessary tools at his fingertips, mounted on the outside of the portable dispenser.

While the present invention has been described in detail with reference to several specific embodiments thereof, it should be understood that these are described by way of illustration only, and not by way of limitation.

The present invention embraces all modifications, variations and changes which come within the scope of the patent claims set forth hereinbelow.

What is claimed is:

1. A portable dispenser for a plurality of fastening means, comprising:

an open-topped container provided with first means therein for temporarily holding said plurality of fastening means and for making said plurality of fastening means readily accessible to a user of said portable dispenser;

second means provided on a first exterior surface of said open-topped container for removably and selectably attaching said portable dispenser to a belt of said user of said portable dispenser;

said first means includes a selectively removable structure which is slidably positioned within said open-topped container;

said open-topped container has a substantially rectangular cross-section which is disposed substantially perpendicularly to a vertical elongated axis of said open-topped container;

said open-topped container has a closed bottom portion formed by two surfaces disposed oblique to said vertical elongated axis of said open-topped container and disposed at an angle relative to each other;

said selectively removable structure temporarily holds said fastening means arranged in rows and columns, and makes said fastening means readily accessible to said user of said portable dispenser;

said first exterior surface of said open-topped container on which said second means is provided comprises the tallest exterior surface on said open-topped container;

said open-topped container includes a second exterior surface which is parallel to and opposite to said first exterior surface, and wherein said second exterior surface is provided with an elongated notch therein which aides said user to position and move said selectively removable structure into and out of said open-topped container; and said selectively removable structure is provided with members which fit on and mate with said two oblique surfaces of said closed bottom portion of said open-topped container.

2. A portable dispenser according to claim 1, wherein:

said slidable selectively removable structure is provided with gripping means at the top thereof to enable said user of said portable dispenser to move said slidable selectively removable structure relative to said open top container for making said plurality of fastening means readily accessible to said user of said portable dispenser.

* * * * *